US006592431B2

(12) United States Patent
Mizuno et al.

(10) Patent No.: US 6,592,431 B2
(45) Date of Patent: Jul. 15, 2003

(54) EYEGLASS LENS PROCESSING APPARATUS

(75) Inventors: Toshiaki Mizuno, Aichi (JP); Shinji Koike, Aichi (JP)

(73) Assignee: Nidex Co., Ltd., Aichi (JP)

( * ) Notice: Subject to any disclaimer, the term of this patent is extended or adjusted under 35 U.S.C. 154(b) by 0 days.

(21) Appl. No.: 10/034,074

(22) Filed: Jan. 3, 2002

(65) Prior Publication Data

US 2002/0115381 A1 Aug. 22, 2002

(30) Foreign Application Priority Data

Jan. 5, 2001 (JP) ..... 2001-000433

(51) Int. Cl.[7] ..... B24B 49/00

(52) U.S. Cl. ..... 451/9; 451/11; 451/21; 451/42; 451/56

(58) Field of Search ..... 451/9, 10, 11, 451/8, 21, 56, 443, 42, 43

(56) References Cited

U.S. PATENT DOCUMENTS

| | | | | |
|---|---|---|---|---|
| 4,555,873 A | | 12/1985 | Smith | |
| 4,584,799 A | * | 4/1986 | Juvet | |
| 5,119,595 A | * | 6/1992 | Ushiyama et al. | |
| 5,149,337 A | * | 9/1992 | Watanabe | |
| 5,643,052 A | | 7/1997 | Delattre et al. | |
| RE35,898 E | | 9/1998 | Shibata et al. | |
| 6,155,911 A | * | 12/2000 | Mandler | 451/42 |
| 6,220,929 B1 | | 4/2001 | Mizuno | |
| 6,261,150 B1 | | 7/2001 | Mizuno et al. | |

FOREIGN PATENT DOCUMENTS

| | | |
|---|---|---|
| EP | 0 566 853 A2 | 10/1993 |
| EP | 0 839 604 A1 | 5/1998 |
| EP | 0 960 689 A1 | 12/1999 |
| JP | 6-47664 | 2/1994 |
| JP | 9-29632 | 2/1997 |

* cited by examiner

*Primary Examiner*—Eileen P. Morgan
(74) *Attorney, Agent, or Firm*—Sughrue Mion, PLLC

(57) ABSTRACT

An eyeglass lens processing apparatus for processing a periphery of an eyeglass lens, includes: a lens rotating unit having rotating shafts for holding and rotating the lens; an abrasive wheel; an abrasive wheel state detecting unit for detecting a lowered processing performance of the abrasive wheel; and a notifying unit for notifying that dressing for the abrasive wheel is required based on a result of detection by the abrasive wheel state detecting unit.

6 Claims, 8 Drawing Sheets

450

SET DRESS REFERENCE

| | |
|---|---|
| ⇨ · ROUGH PROCESSING ABRASIVE WHEEL DRESS MESSAGE | TR1: 5.00MIN |
| · FINISHING ABRASIVE WHEEL DRESS MESSAGE | TF1: 5.00MIN |
| · STOP PROCESSING OF ROUGH PROCESSING ABRASIVE WHEEL | TR2: 10.00MIN |
| · STOP PROCESSING OF FINISHING ABRASIVE WHEEL | TF2: 10.00MIN |

EYEGLASS LENS PROCESSING APPARATUS

BACKGROUND OF THE INVENTION

The present invention relates to an eyeglass lens processing apparatus for processing a periphery of an eyeglass lens.

An eyeglass lens processing apparatus for processing a periphery of an eyeglass lens comprises a circular abrasive wheel (grindstone) having a diamond layer formed of a fine diamond particle and metal powder and serves to carry out processing by causing the periphery of the lens to come in contact with the rotating abrasive wheel by pressure.

In such processing using the abrasive wheel, if a large number of lenses are processed, the diamond particle slips off or is worn away or clogged so that the processing performance of the abrasive wheel is deteriorated and a time required for processing the lens is increased. In such a case, generally, dressing is carried out through a dressing bar in order to arrange the diamond layer.

However, it is difficult for an operator to carry out the dressing in a proper timing. More specifically, there is a problem in that it is hard for the operator to decide whether or not the processing time is increased and when the dressing is to be carried out.

SUMMARY OF THE INVENTION

In consideration of the drawbacks of the conventional apparatus, it is a technological object of the invention to provide an eyeglass lens processing apparatus capable of easily managing a time that the dressing is to be carried out over an abrasive wheel.

In order to attain the object, the invention has the following structure.

(1) An eyeglass lens processing apparatus for processing a periphery of an eyeglass lens, comprising:
- lens rotating means having rotating shafts for holding and rotating the lens;
- an abrasive wheel;
- abrasive wheel state detecting means for detecting a lowered processing performance (i.e., unsatisfactory) of the abrasive wheel; and
- notifying means for notifying that dressing for the abrasive wheel is required based on a result of detection by the abrasive wheel state detecting means.

(2) The eyeglass lens processing apparatus according to (1), further comprising:
- processing state detecting means for detecting a state of processing for the lens; and
- wherein the abrasive wheel state detecting means detects the lowered processing performance of the abrasive wheel based on a result of comparison between the detected state of processing and a predetermined reference.

(3) The eyeglass lens processing apparatus according to (2), wherein:
- the processing state detecting means detects a processing time from a start of processing; and
- the abrasive wheel state detecting means detects the lowered processing performance of the abrasive wheel in case that the detected processing time exceeds a predetermined reference processing time.

(4) The eyeglass lens processing apparatus according to (2), wherein:
- the processing state detecting means detects an end of processing over the entire periphery of the lens or at a predetermined rotation angle of the lens; and
- the abrasive wheel state detecting means detects the lowered processing performance of the abrasive wheel in case that the end of processing is not detected within a predetermined reference processing time.

(5) The eyeglass lens processing apparatus according to (2), wherein:
- the processing state detecting means detects a number of lens rotation from a start of processing; and
- the abrasive wheel state detecting means detects the lowered processing performance of the abrasive wheel in case that the detected number of lens rotation exceeds a predetermined reference number of lens rotation.

(6) The eyeglass lens processing apparatus according to (2), wherein:
- the processing state detecting means detects an end of processing over the entire periphery of the lens or at a predetermined rotation angle of the lens; and
- the abrasive wheel state detecting means detects the lowered processing performance of the abrasive wheel in case that the end of processing is not detected within a predetermined reference number of lens rotation.

(7) The eyeglass lens processing apparatus according to (2), wherein:
- the processing state detecting means detects an amount of processing at a predetermined rotation angle of the lens; and
- the abrasive wheel state detecting means detects the lowered processing performance of the abrasive wheel in case that the amount of processing detected within a predetermined processing time or a predetermined number of lens rotation does not meet a predetermined reference amount of processing.

(8) The eyeglass lens processing apparatus according to (2), further comprising:
- changing means for changing a value of the reference.

(9) The eyeglass lens processing apparatus according to (8), further comprising:
- lens thickness input means for inputting a thickness of the lens; and
- wherein the changing means changes the reference value based on the inputted lens thickness.

(10) The eyeglass lens processing apparatus according to (2), further comprising:
- lens material input means for inputting a material of the lens to be processed; and
- wherein the processing state detecting means detects the state of processing for the lens only in case that a glass is inputted as the material.

(11) The eyeglass lens processing apparatus according to (2), wherein:
- the processing state detecting means detects the states of processing for a plurality of lenses; and
- the abrasive wheel state detecting means detects the lowered processing performance of the abrasive wheel based on a result of comparison between an average of the detected states of processing and the predetermined reference.

(12) The eyeglass lens processing apparatus according to (1), further comprising:
- processing control means for controlling processing for the lens based on a result of detection by the abrasive wheel state detecting means.

(13) The eyeglass lens processing apparatus according to (12), further comprising:

processing state detecting means for detecting a state of processing for the lens;

wherein the abrasive wheel state detecting means detects the lowered processing performance of the abrasive wheel based on a result of comparison between the detected state of processing and predetermined first and second references; and wherein the processing control means stops the processing for the lens based on a result of comparison by the abrasive wheel state detecting means using either one of the first and second references.

(14) The eyeglass lens processing apparatus according to (1), wherein:

the abrasive wheel includes a rough processing abrasive wheel and finish processing abrasive wheel; and the notifying means gives a notification regarding the rough processing abrasive wheel and a notification regarding the finish processing abrasive wheel independently of each other.

(15) An eyeglass lens processing apparatus for processing a periphery of an eyeglass lens, comprising:

an abrasive wheel;

counting means for counting a number of lenses which have been processed; and notifying means for notifying that dressing for the abrasive wheel is required in case that the counted number of lenses exceed a predetermined reference number.

(16) The eyeglass lens processing apparatus according to (15), further comprising:

lens material input means for inputting a material of the lens to be processed; and wherein the counting means only counts the number of the processed lenses, each being inputted as a glass by the input means.

The present disclosure relates to the subject matter contained in Japanese patent application No. 2001-433 (filed on Jan. 15, 2001), which is expressly incorporated herein by reference in its entirety.

DESCRIPTION OF THE PREFERRED EMBODIMENT

Figure 1:
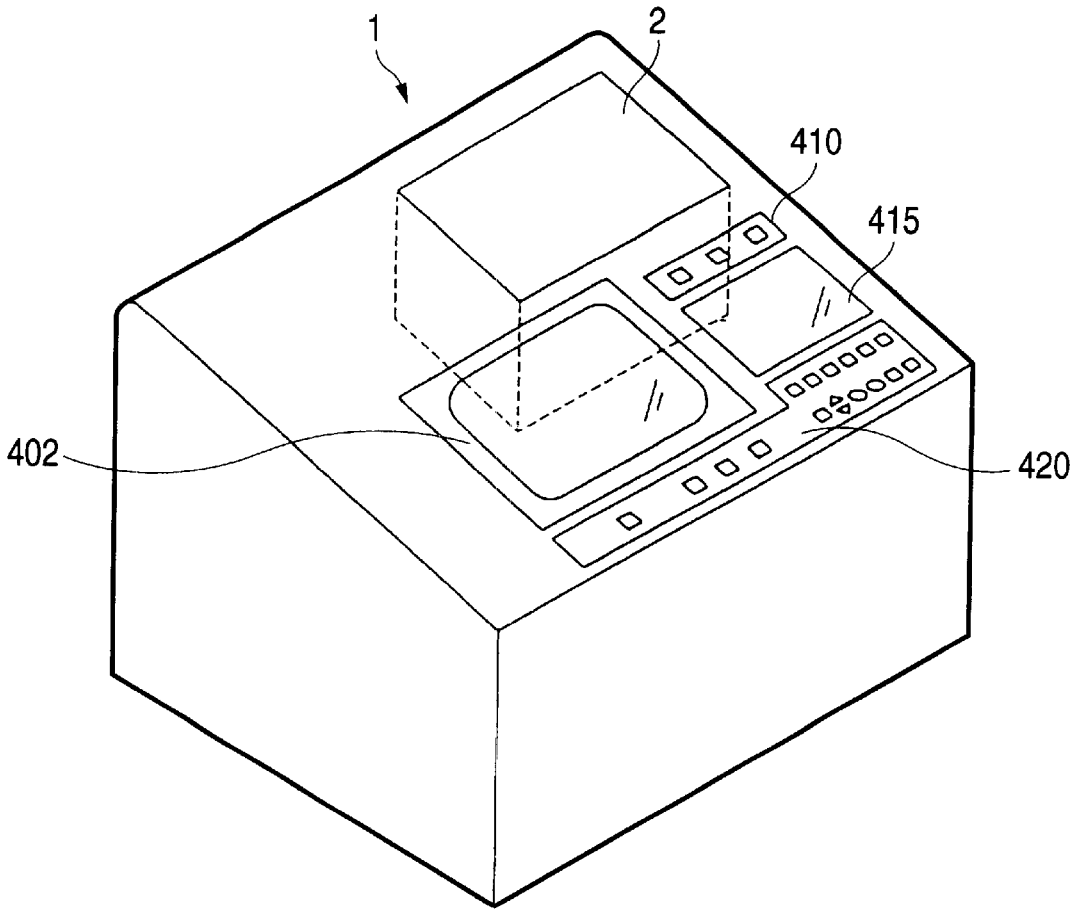
FIG. 1 is a view showing a structure of the appearance of an eyeglass lens processing apparatus according to the invention.

Hereafter, a description will be given of an embodiment of the invention. FIG. 1 is a diagram illustrating the external configuration of an eyeglass-lens processing apparatus in accordance with the invention. An eyeglass-frame-shape measuring device 2 is incorporated in an upper right-hand rear portion of a main body 1 of the apparatus. As the frame-shape measuring device 2, ones that disclosed in U.S. Pat. Nos. 5,228,242, 5,333,412, U.S. Pat. No. 5,347,762 (Re. 35,898) and so on, the assignee of which is the same as the present application, can be used. A switch panel section 410 having switches for operating the frame-shape measuring device 2 and a display 415 for displaying processing information and the like are disposed in front of the frame-shape measuring device 2. Further, reference numeral 420 denotes a switch panel section having various switches for inputting processing conditions and the like and for giving instructions for processing, and numeral 402 denotes an openable window for a processing chamber.

Figure 2:
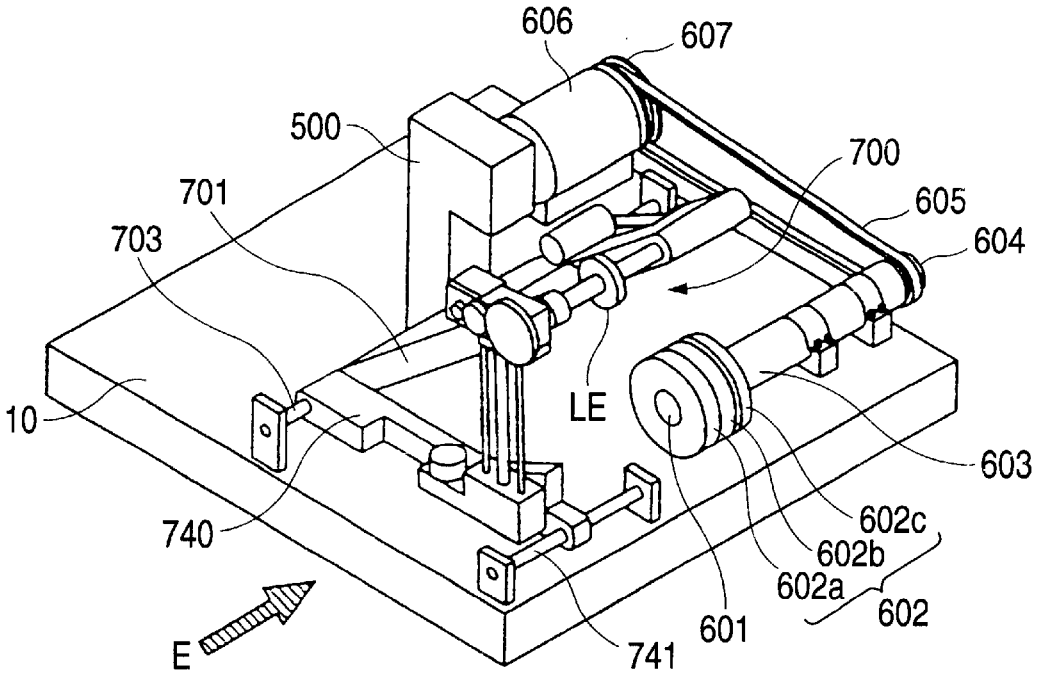
FIG. 2 is a perspective view showing a schematic structure of a processing section provided in a housing of an apparatus body.

FIG. 2 is a perspective view illustrating the arrangement of a lens processing section disposed in the casing of the main body 1. A carriage section 700 is mounted on a base 10, and a subject lens LE clamped by a pair of lens rotation shafts (lens chuck shafts) 702L and 702R of a carriage 701 is ground by a group of abrasive wheels 602 attached to an abrasive wheel rotating shaft 601. The group of abrasive wheels 602 include a rough abrasive wheel 602*a* for plastic lenses, a rough abrasive wheel 602*b* for glass lenses, and a finishing abrasive wheel 602*c* for beveling processing and flat processing. The rotating shaft 601 is rotatably attached to the base 10 by a spindle 603. A pulley 604 is attached to an end of the rotating shaft 601, and is linked through a belt 605 to a pulley 607 which is attached to a rotating shaft of an abrasive-wheel rotating motor 606. A lens-shape measuring section 500 is provided in the rear of the carriage 701. As the lens-shape measuring section 500, not only one that is disclosed by Japanese patent publication No. 2000-317796, but also other conventional devices can be used.

Figure 3:
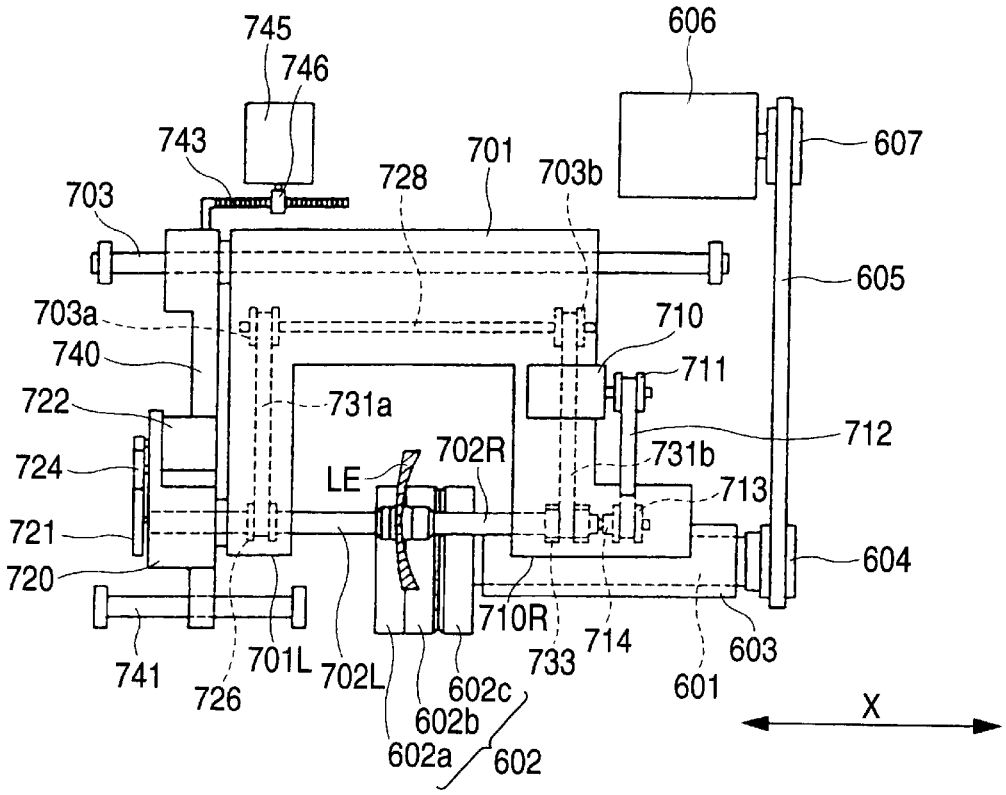
FIG. 3*a* and 3*b* are views showing a schematic structure of a main part of a carriage section.
Figure 3:
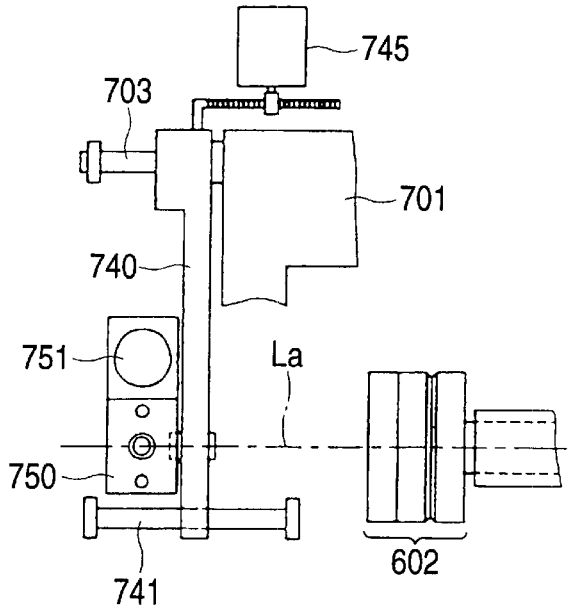
Figure 4:
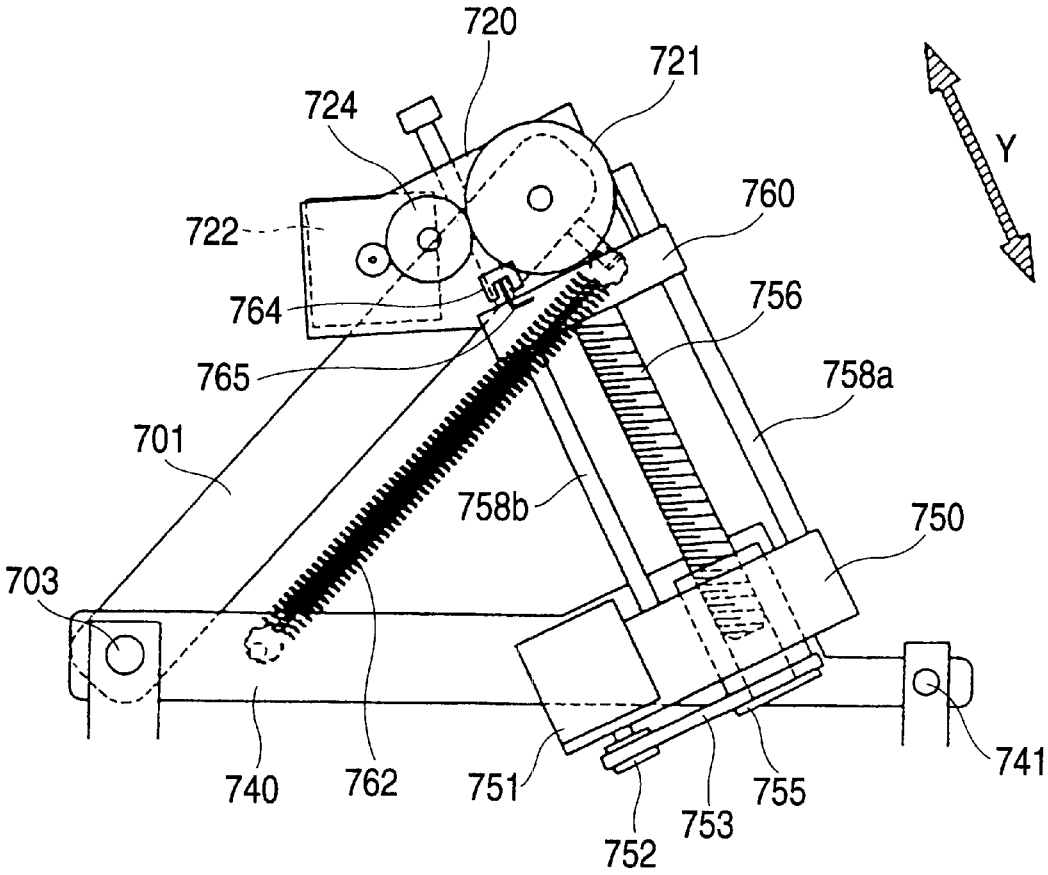
FIG. 4 is a view showing the carriage section seen in a direction of E in FIG. 2.

Referring to FIGS. 2, 3, and 4, a description will be given of the construction of the carriage section 700. FIG. 3 is a schematic diagram of essential portions of the carriage section 700, and FIG. 4 is a view, taken from the direction of arrow E in FIG. 2, of the carriage section 700.

The carriage 701 is capable of rotating the lens LE while chucking it with two shafts 702L and 702R, and is rotatably slidable with respect to a carriage shaft 703 that is fixed to the base 10 and that extends in parallel to the shaft 601. Hereafter, a description will be given of a lens chuck mechanism and a lens rotating mechanism as well as an X-axis moving mechanism and a Y-axis moving mechanism of the carriage 701 by assuming that the direction in which the carriage 701 is moved in parallel to the abrasive-wheel rotating shaft 601 is the X axis, and the direction for changing the axis-to-axis distance between the shafts (702L, 702R) and the shaft 601 by the rotation of the carriage 701 is the Y axis.

<Lens Chuck Mechanism and Lens Rotating Mechanism>

The shaft 702L and the shaft 702R are rotatably held coaxially by a left arm 701L and a right arm 701R, respectively, of the carriage 701. A chucking motor 710 is fixed to the center of the upper surface of the right arm 701R, and the rotation of a pulley 711 attached to a rotating shaft of the motor 710 rotates a feed screw 713, which is rotatably held inside the right arm 701R, by means of a belt 712. A feed nut 714 is moved in the axial direction by the rotation of the feed screw 713. As a result, the shaft 702R connected to the nut 714 can be moved in the axial direction, so that the lens LE is clamped by the shafts 702L and 702R.

A rotatable block 720 for attaching a motor, which is rotatable about the axis of the shaft 702L, is attached to a left-side end portion of the left arm 701L, and the chuck shaft 702L is passed through the block 720, a gear 721 being secured to the left end of the shaft 702L. A pulse motor 722 for lens rotation is fixed to the block 720, and as the motor 722 rotates the gear 721 through a gear 724, the rotation of the motor 720 is transmitted to the shaft 702L. A pulley 726 is attached to the shaft 702L inside the left arm 701L. The pulley 726 is linked by means of a timing belt 731*a* to a pulley 703*a* secured to a left end of a rotating shaft 728, which is held rotatably in the rear of the carriage 701. Further, a pulley 703*b* secured to a right end of the shaft 728 is linked by means of a timing belt 731*b* to a pulley 733 which is attached to the shaft 702R in such a manner as to be slidable in the axial direction of the shaft 702R inside the right arm 701R. By virtue of this arrangement, the shaft 702L and the shaft 702R are rotated synchronously.

<X-Axis Moving Mechanism and Y-Axis Moving Mechanism of Carriage>

The shaft 703 is provided with a movable arm 740 which is slidable in its axial direction so that the arm 740 is movable in the X-axis direction (in the axial direction of the shaft 703) together with the carriage 701. Further, the arm 740 at its front portion is slidable on and along a guide shaft 741 that is secured to the base 10 in a parallel positional relation to the shaft 703. A rack 743 extending in parallel to the shaft 703 is attached to a rear portion of the arm 740, and this rack 743 meshes with a pinion 746 attached to a rotating shaft of a motor 745 for moving the carriage in the X-axis direction, the motor 745 being secured to the base 10. By virtue of the above-described arrangement, the motor 745 is able to move the carriage 701 together with the arm 740 in the axial direction (in the X-axis direction).

As shown in FIG. 3(*b*), a swingable block 750 is attached to the arm 740 in such a manner as to be rotatable about the axis La which is in alignment with the rotational center of the shaft 601. The distance from the center of the shaft 703 to the axis La and the distance from the center of the shaft 703 to the rotational center of the shaft (702L, 702R) are set to be identical. A Y-axis moving motor 751 is attached to the block 750, and the rotation of the motor 751 is transmitted by means of a pulley 752 and a belt 753 to a female screw 755 held rotatably in the block 750. A feed screw 756 is inserted in a threaded portion of the screw 755 in mesh therewith, and the screw 756 is moved vertically by the rotation of the screw 755.

A guide block 760 which abuts against a lower end surface of the block 720 is fixed to an upper end of the screw 756, and the block 760 moves along two guide shafts 758*a* and 758*b* implanted on the block 750. Accordingly, as the block 760 is vertically moved together with the screw 756 by the rotation of the motor 751, it is possible to change the vertical position of the block 720 abutting against the block 760. As a result, the vertical position of the carriage 701 attached to the block 720 can be also changed (namely, the carriage 701 rotates about the shaft 703 to change the axis-to-axis distance between the shafts (702L, 702R) and the shaft 601). A spring 762 is stretched between the left arm 701L and the arm 740, so that the carriage 701 is constantly urged downward to impart processing pressure onto the lens LE. Although the downward urging force acts on the carriage 701, the downward movement of the carriage 701 is restricted such that the carriage 701 can only be lowered down to the position in which the block 720 abuts against the block 760. A sensor 764 for detecting an end of processing is attached to the block 720, and the sensor 764 detects the end of processing at each radius vector angle of the lens LE (each rotation angle) by detecting the position of a sensor plate 765 attached to the block 760.

Figure 5:
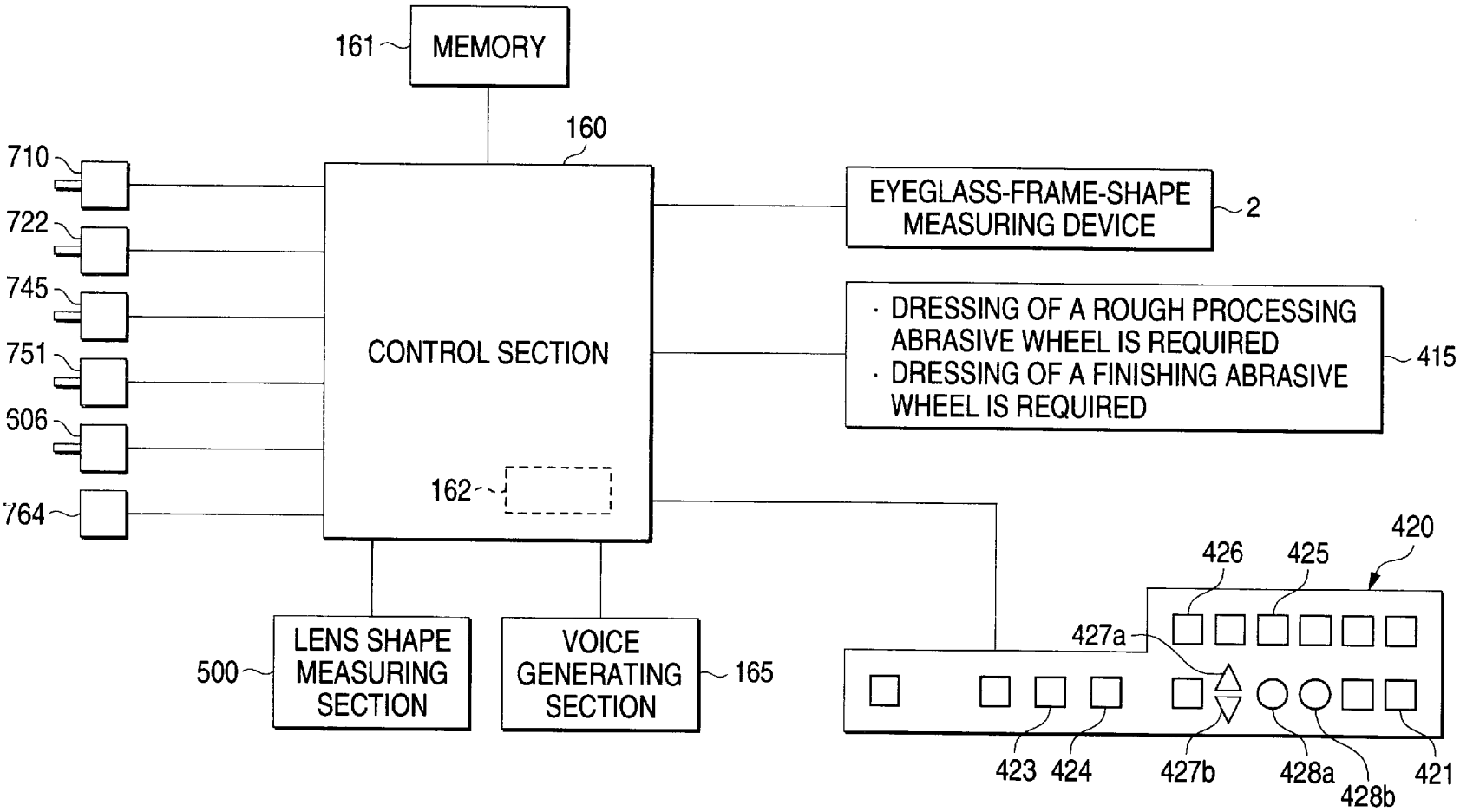
FIG. 5 is a block diagram showing a control system of the apparatus.

The operation of the apparatus described above will be explained with reference to a block diagram showing a control system in FIG. 5. First of all, the whole processing operation of the apparatus will be described. Herein it is assumed that a glass lens is processed.

The shape of an eyeglass frame (or a template) for fitting is measured by the frame shape measuring device 2, and data thus obtained by the measurement are input to a data memory 161 by pressing a switch 421. By operating each switch of a switch panel section 420, an operator inputs necessary layout data such as the PD of a wearer and the height of an optical center, the material of the lens and a processing mode. The material of the lens is specified with a switch 426. If the necessary input is completed, the lens LE is chucked and processed through the shaft 702L and the shaft 702R.

When the apparatus is operated by pressing a start switch 423, a control section 160 operates the lens shape measuring section 500 to measure the shapes of the front and rear surfaces of the lens. By the measurement, the thickness of a lens having a processing radius vector shape is obtained. When the shape of the lens is obtained, the control section 160 operates each data on rough processing and finishing processing for each radius vector angle in accordance with a predetermined program based on the input data. In order of the rough processing and the finishing processing, the processing is automatically executed.

The control section 160 drives the motor 745 such that the lens LE comes to a portion above the rough abrasive wheel 602*b* for glass, and thus moves the carriage 701. Based on rough processing data, then, the motor 751 is rotated to move the carriage 701 in a Y-axis direction and the lens LE is rotated by the motor 722 to carry out the rough processing. The movement of the carriage 701 in the Y-axis direction and the rotation of the lens LE are repeated until the end of the processing is detected by the sensor 764 over the whole radius vector angle of the lens LE. When the end of the processing is detected, the rough processing is completed.

When the rough processing is completed, the finishing processing is successively executed automatically after the lens LE is removed from the rough abrasive wheel 602*b*. In the case of finishing processing for beveling, after the lens LE is moved to a beveling groove portion of the finishing abrasive wheel 602*c*, the rotation of the lens LE and the movement of the carriage 701 in the Y-axis and X-axis directions are controlled based on the finishing processing data. When the end of the processing is detected over the whole periphery of the lens LE through the sensor 764, the finishing processing is completed.

Figure 6:
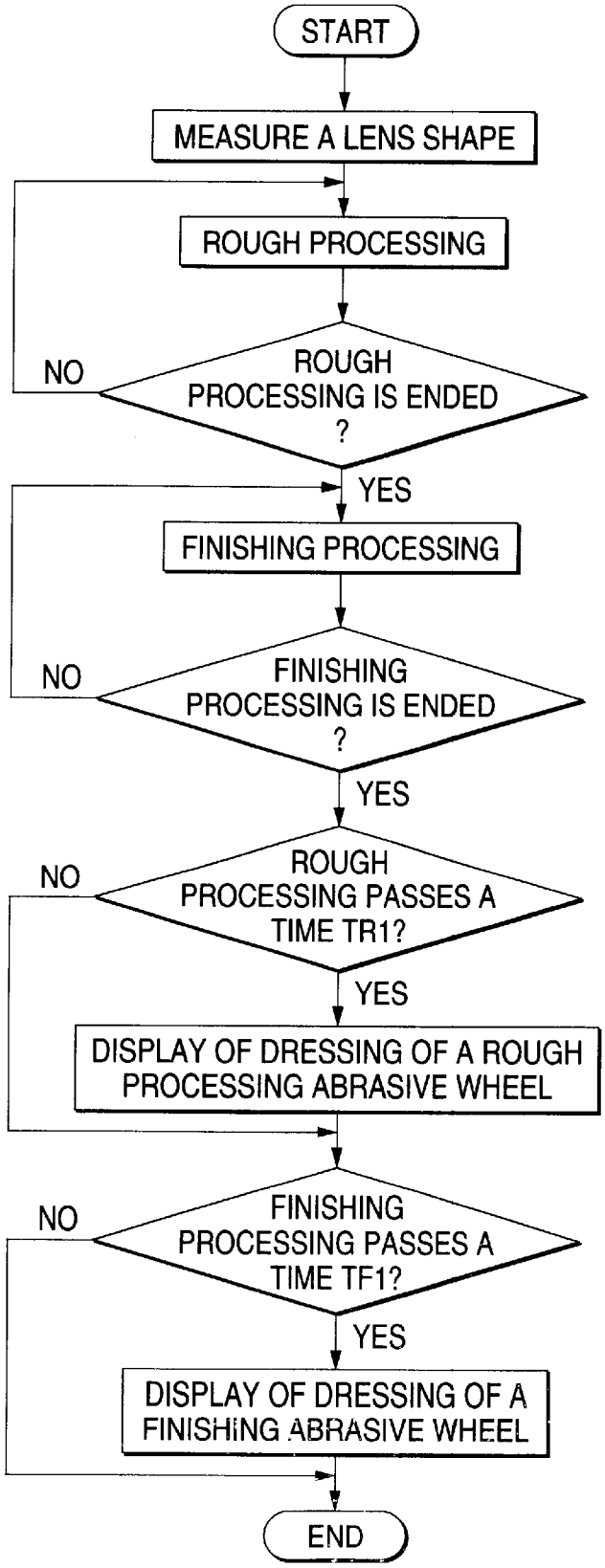
FIG. 6 is a flow chart for explaining an operation for detecting a deterioration in the processing performance of each abrasive wheel.

By repeating such processing, a large number of lenses are processed. In the rough abrasive wheel 602*b* and the finishing abrasive wheel 602*c*, consequently, processing performance is deteriorated due to slip-off or wear of the diamond particle so that a time required for processing the lens is gradually increased. The control section 160 measures times required from the start of the rough processing and the finishing processing by means of a counting function 162 provided therein. By the result of the measurement, a deterioration in the processing performance of each abrasive wheel is detected and a notice that dressing is required is given to an operator based on the result of the detection (see a flow chart of FIG. 6).

During the rough processing, when the measured time for the rough processing passes a preset reference time TR1 (for example, 5 minutes) (when the end of the processing of the whole periphery is not detected by the sensor 764 even if the time TR1 passes), the control section 160 causes the display 415 to display a message that the dressing is required for the rough abrasive wheel 602*b*. While the display is carried out when all processing including the finishing processing is completed, it may be performed when the time TR1 passes.

Similarly, when the measured time for the finishing processing passes a preset reference time TF1 (for example, 5 minutes) (when the end of the processing of the whole periphery is not detected by the sensor 764 even if the time TF1 passes), in the finishing processing, a message that the dressing of the finishing abrasive wheel 602*c* is required is displayed on the display 415 after the processing is completed.

In addition to the display of the message, the notice that the dressing is required may be given in a voice or an alarm by a voice generating section 165.

By the notice, the operator can precisely know a time that the dressing is required for the respective abrasive wheels. After the notice of each dressing is displayed on the display 415, a stop switch 424 is pressed to erase the display of the message, thereby carrying out the necessary dressing.

Figure 7:
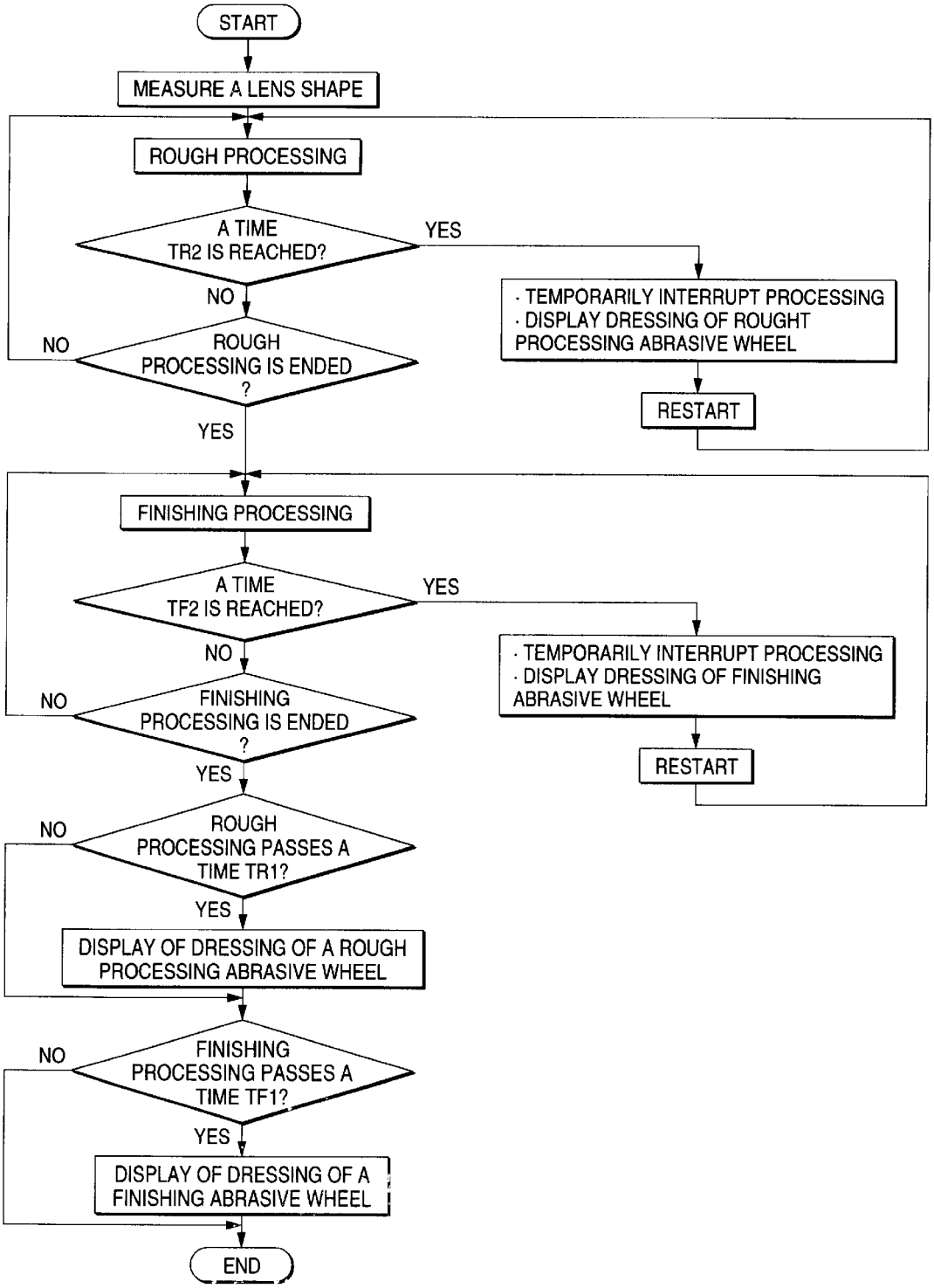
FIG. 7 is a flow chart for explaining an operation for temporarily interrupting the processing.

When the processing time is increased, moreover, the processing may be once interrupted to carry out the dressing and may be then restarted. FIG. 7 is a flow chart showing an operation to be carried out with such a structure. The control section 160 measures a time required from the start of the rough processing. When the measured time for the rough processing exceeds a preset reference time TR2 (for example, 10 minutes) (when the end of the processing of the whole periphery is not detected by the sensor 764 even if the time TR2 is reached), the carriage 701 is raised to separate the lens LE from the rough abrasive wheel 602*b* and the rotation of the lens LE and that of the abrasive wheel are stopped to interrupt the processing. At the same time, a message that the processing is interrupted and the dressing of the rough abrasive wheel 602*b* is required is displayed on the display 415. When the processing is interrupted, the operator presses the switch 424 to erase the display of the message and sets a dress mode with a switch 425, thereby carrying out the dressing over the rough abrasive wheel 602*b* in a predetermined procedure. Then, the switch 423 is pressed to restart the rough processing.

Also in the finishing processing, similarly, the control section 160 measures the time required from the start of the finishing processing. When the measured time for the finishing processing exceeds a predetermined reference time TF2 (for example, 10 minutes) (when the end of the processing of the whole periphery is not detected by the sensor 764 even if the time TF2 is reached), the processing to be carried out by the finishing abrasive wheel 602*c* is once interrupted. After the finishing abrasive wheel 302*c* is subjected to the dressing, the switch 423 is pressed to restart the finishing processing.

For the times TR1 and TF1, suitable times are predetermined in consideration of a time required for processing a thick lens (a lens having a large processing amount) in a state in which the diamond layers of the abrasive wheels 602*b* and 602*c* are normally arranged or an increase in the processing time with an increase in the number of lenses to be processed.

Moreover, while the times TR2 and TF2 required for deciding whether or not the processing is temporarily interrupted may be equal to the times TR1 and TF1 for the message display, it is advantageous that the times TR2 and TF2 are set to be longer than the times TR1 and TF1. More specifically, in the case in which TR2=TR1 and TF2=TF1 are set, the processing is always interrupted temporarily if it is decided that the necessary time for the dressing arrives. Consequently, a great deal of time and labor is taken for reprocessing and a processing error is apt to be made. On the other hand, if TR2 and TF2 are set to be longer than TR1 and TF1 respectively, it is preferable that the lens should be completely processed and the dressing should be carried out before the measured times (processing times) TR2 and TF2 are reached. Therefore, it is possible to eliminate a great deal of time and labor of the reprocessing and a processing error caused by the reprocessing. It is effective to set the times TR2 and TF2 that the processing is once interrupted in that the processing time can be prevented from being excessively increased and a state in which the end of the processing is not detected can be avoided.

While the reference for detecting a deterioration in the processing performance of the abrasive wheel is managed by the time in the embodiment, the number of rotations of the lens LE can also be employed. The reason is that a time required for completing the processing and the number of rotations of the lens LE are almost proportional to each other in the case in which the lens LE is to be processed by a rotation at an almost equal speed. The number of rotations of the lens LE can be known from the number of rotations of the motor 722.

In the lens processing, moreover, when the end of the processing is detected at a predetermined radius vector angle, the lens is rotated every minute angle and such an operation is repeated over the whole periphery. Thus, processing control is carried out. In this case, it is also possible to detect a deterioration in the processing performance of each abrasive wheel by a comparison of a time required for the end of the processing at an angle for the start of the processing with a preset reference time.

Moreover, the detection of a deterioration in the processing performance is not always carried out every time the lens is to be processed. A time required for the end of the processing for each lens or the number of rotations of the lens may be stored in a memory and, for example, a mean value of 10 lenses which is stored may be compared with a reference value. Thus, it is possible to evaluate the deterioration in the processing performance of the abrasive wheel with an overall tendency.

Figures 8, 9:
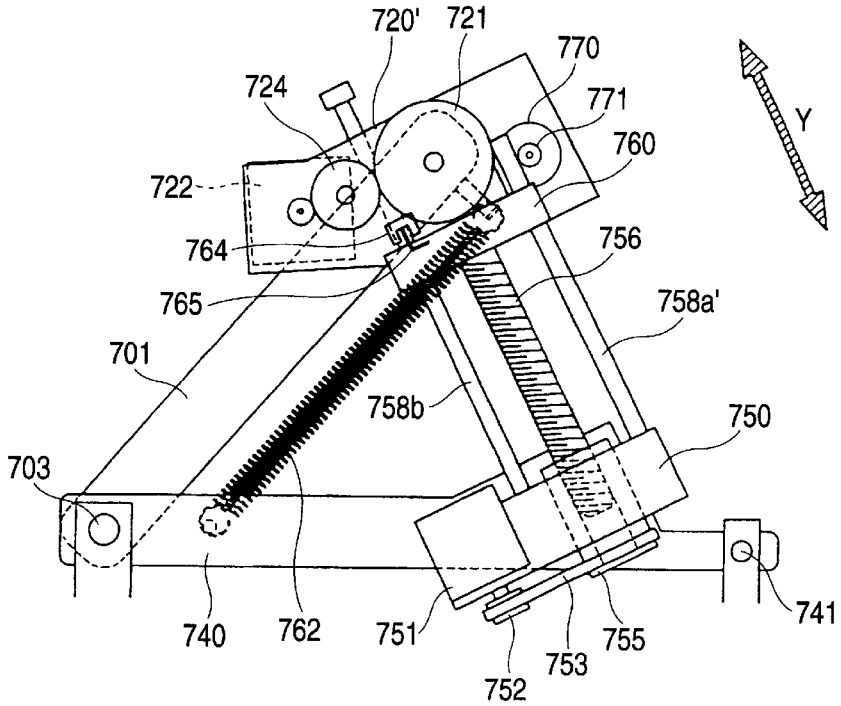
FIG. 8 is a diagram showing an example of a screen obtained when each reference time for message display and processing stop are to be changed.
FIG. 9 is a view illustrating another embodiment.

Moreover, it is advantageous for the operator to optionally change each reference value for deciding whether or not a notice for the promotion of the dressing is to be given and the processing is to be stopped. In the case in which the times TR1, TR2, TF1 and TF2 in the above example are to be changed, the following operation is carried out. First of all, a parameter setting screen for changing a dress reference such as the time TR1 is called over the display 415 with the switch 426. FIG. 8 shows an example of the screen obtained at that time. After a cursor 450 is set to a parameter item to be changed with switches 427*a* and 427*b* for moving the cursor 450, a set time is changed with numeric variation switches 428*a* and 428*b*. The switch 426 is pressed again to get out of the parameter setting screen. Consequently, each reference time to be managed by the control section 160 is updated.

Moreover, there is a tendency in which a thick lens has a long processing time and a thin lens has a short processing time. By utilizing data on a lens thickness obtained as a result of the measurement of the lens shape measuring section 500, therefore, it is also possible to determine a decision reference of a deterioration in processing performance. For example, the control section 160 changes a decision reference value corresponding to the data on the lens thickness such that a reference time is increased if the lens thickness is great and is reduced if the lens thickness is small.

FIG. 9 is a view illustrating another embodiment. Only different portions from those of the embodiment described above are shown and the structures shown according to the embodiment described above are employed for the same functions. In FIG. 9, an encoder 770 is fixed to a block 720' for motor attachment and a pinion 771 attached to a rotating shaft of the encoder 770 meshes with a rack formed on a guide shaft 758*a*' extended in parallel with a feed screw 756. The output of the encoder 770 is input to the control section 160 and the moving distance of elevation (Y-axis movement) of the carriage 701 is detected.

Description will be given to the detection of a deterioration in the processing performance of an abrasive wheel with such a structure. In the case in which the lens LE is processed by a rotation at an almost equal speed (particularly, rough processing), the output of the encoder 770 obtained by processing the lens LE with one rotation is first stored every predetermined angle. Next, the output of the encoder 770 is obtained every equal angle when a second rotation is started. Consequently, a processing distance (a processing amount) for each angle is obtained from the first rotation to the second rotation. The processing distance (the processing amount) for each angle is compared with a predetermined reference processing distance (a reference processing amount). If the processing distance is equal to or smaller than the reference processing distance, it is decided that the processing performance is deteriorated.

Moreover, in the case in which the lens LE is to be rotated and processed after the end of the processing is detected for each lens rotating angle, a processing distance within a predetermined time at an angle for the start of the processing is compared with the reference processing distance. If the progress of the processing is slow, it is decided that the processing performance is deteriorated. In the case of a variant, furthermore, it is preferable that the operator can optionally change each reference value.

As another variant, furthermore, it is also possible to give a notice of a time that the dressing is required for the rough abrasive wheel 602*b* and the finishing abrasive wheel 602*c* depending on whether or not the number of processed glass lenses reaches a reference number. Based on the input of a material when setting the processing conditions, the control section 160 decides whether the material of the processed lens is glass or not. When the operator executes an operation for erasing a message display in order to carry out the dressing, the control section 160 resets a count number.

As described above, the invention can be variously changed and various changes are also included in the invention within the same technical thought.

As described above, according to the invention, it is possible to easily manage the dressing time of an abrasive wheel.

What is claimed is:

1. An eyeglass lens processing apparatus for processing a periphery of an eyeglass lens, comprising:

lens rotating means having rotating shafts for holding and rotating the lens;

an abrasive wheel;

processing state detecting means for detecting at least one of a processing time and a number of lens rotation from a start of processing;

notifying means for notifying that dressing for the abrasive wheel is required when the detected processing time exceeds a reference processing time or the detected number of lens rotation exceeds a reference number of lens rotation;

lens thickness input means for inputting a thickness of the lens; and changing means for changing at least one of the reference the reference processing time and the reference, number of lens rotation based on the inputted lens thickness.

2. An eyeglass lens processing apparatus for processing a periphery of an eyeglass lens, comprising:

lens rotating means having rotating shafts for holding and rotating the lens:

an abrasive wheel;

processing state detecting means for detecting at least one of a processing time and number of lens rotation from a start of processing to an end of the processing for a plurality of lenses; and notifying means for notifying that dressing for the abrasive wheel is required when an average of the detected processing times exceeds a reference processing time or an average of the detected numbers of lens rotation exceeds a reference number of lens rotation.

3. An eyeglass lens processing apparatus for processing a periphery of an eyeglass lens, comprising:

lens rotating means having rotating shafts for holding and rotating the lens;

abrasive wheels;

processing state detecting means for detecting at least one of a processing time and a number of lens rotation from a start of processing;

notifying means for notifying that the dressing for at least one of the abrasive wheels is required when the detected processing time exceeds a first reference processing time or the detected number of lens rotation exceeds a first reference number of lens rotation; and processing control means for stopping the processing for the lens when the detected processing time exceeds a second reference processing time longer than the first reference processing time or the detected number of lens rotation exceeds a second reference number of lens larger than the first reference number of lens rotation.

4. The eyeglass lens processing apparatus according to claim 3, wherein:

the abrasive wheels include a rough processing abrasive wheel and finish processing abrasive wheel; and the notifying means gives a notification regarding the rough processing abrasive wheel and a notification regarding the finish processing abrasive wheel independently of each other.

5. The eyeglass lens processing apparatus according to claim 3, further comprising:

lens material input means for inputting a material of the lens to be processed; and wherein the processing state detecting means detects only the at least one of the processing time and the number of lens rotation of the lens of which the lens material has been inputted as a glass by the lens material input means.

6. An eyeglass lens processing apparatus for processing a periphery of an eyeglass lens, comprising:

an abrasive wheel;

lens material input means for identifying a material of the lens to be processed;

counting means for counting only a number of the processed lenses was inserted therefore;

by the lens material input means; and notifying means for notifying that dressing for the abrasive wheel is required when the counted number of the processed lenses identified as being made of glass exceeds a reference number of processed lenses.

* * * * *